US009975055B2

(12) United States Patent
Cai

(10) Patent No.: US 9,975,055 B2
(45) Date of Patent: May 22, 2018

(54) DOUBLE-SIDED TOY CAR CAPABLE OF VERTICAL TURNING WITHIN SEALED TRACK

(71) Applicants: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

(72) Inventor: Dongqing Cai, Shantou (CN)

(73) Assignees: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

( * ) Notice: Subject to any disclaimer, the term of this patent is extended or adjusted under 35 U.S.C. 154(b) by 0 days. days.

(21) Appl. No.: 15/314,225

(22) PCT Filed: Jun. 30, 2015

(86) PCT No.: PCT/CN2015/082913

§ 371 (c)(1),
(2) Date: Nov. 28, 2016

(87) PCT Pub. No.: WO2016/050103

PCT Pub. Date: Apr. 7, 2016

(65) Prior Publication Data

US 2017/0095745 A1 Apr. 6, 2017

(30) Foreign Application Priority Data

Sep. 30, 2014 (CN) ..... 2014 1 0517935

(51) Int. Cl.
*A63H 17/00* (2006.01)
*A63H 17/26* (2006.01)
*A63H 17/14* (2006.01)

(52) U.S. Cl.
CPC ..... *A63H 17/262* (2013.01); *A63H 17/004* (2013.01); *A63H 17/14* (2013.01)

(58) Field of Classification Search
CPC ..... A63H 17/00; A63H 17/004; A63H 17/14; A63H 17/26; A63H 17/262; A63H 29/22; A63H 30/04

(Continued)

(56) References Cited

U.S. PATENT DOCUMENTS 1,868,313 A * 7/1932 Armin ..... A63H 17/004 446/457
3,445,959 A * 5/1969 Disko ..... A63H 17/004 446/442

(Continued)

FOREIGN PATENT DOCUMENTS

CN 103816665 A 5/2014
CN 204121751 U 1/2015
GB 2214099 A 8/1989

OTHER PUBLICATIONS

ISA/CN, International Search Report for PCT/CN2015/082913, dated Sep. 28, 2015.

*Primary Examiner* — Alexander Niconovich
(74) *Attorney, Agent, or Firm* — Hodgson Russ LLP

(57) ABSTRACT

This double-sided toy car is capable of vertical turning within a sealed track. The double-sided toy car includes a car body, a front wheel, and a rear wheel. The rear wheel includes a pair of upper driving wheels and a pair of lower driving wheels. A maximum distance between an upper end and a lower end of the front wheel is less than or equal to a maximum distance between the upper and lower driving (Continued)

wheels after the rear wheel is maximally elastically contracted. The maximum distance is less than or equal to a height of the sealed track, therefore ensuring that the double-sided car can smoothly pass through a vertical turning segment. However, the maximum distance between the upper and lower driving wheels before the rear wheel is elastically contracted is greater than the height of the sealed track.

13 Claims, 3 Drawing Sheets

(58) Field of Classification Search
USPC ..... 446/431, 437, 444, 456, 465, 470
See application file for complete search history.

(56) References Cited

U.S. PATENT DOCUMENTS 3,733,739 A * 5/1973 Terzian ..... A63H 17/26 446/462
4,300,308 A * 11/1981 Ikeda ..... A63H 17/40 446/457
4,813,906 A * 3/1989 Matsuyama ..... A63H 17/004 446/457
4,969,851 A * 11/1990 Rasmussen ..... A63H 17/004 446/441
5,173,073 A * 12/1992 Franzone ..... A63H 17/00 446/465
5,667,420 A * 9/1997 Menow ..... A63H 17/004 180/22
5,727,985 A * 3/1998 George ..... A63H 17/004 446/437
5,752,871 A * 5/1998 Tsuzuki ..... A63H 17/004 180/209
5,921,843 A * 7/1999 Skrivan ..... A63H 17/14 446/431
6,024,627 A * 2/2000 Tilbor ..... A63H 17/004 446/233
6,132,287 A * 10/2000 Kuralt ..... A63H 17/004 446/431
6,648,722 B2 * 11/2003 Lynders ..... A63H 17/004 446/437
6,688,938 B1 * 2/2004 Lee ..... A63H 17/14 446/129
7,033,241 B2 * 4/2006 Lee ..... A63H 17/00 446/427
7,172,488 B2 * 2/2007 Moll ..... A63H 17/00 446/437
7,234,992 B2 * 6/2007 Weiss ..... A63H 17/28 446/454
7,494,398 B2 * 2/2009 Laurienzo ..... A63H 17/008 446/454
8,038,504 B1 * 10/2011 Wong ..... A63H 30/04 446/431
8,342,904 B2 * 1/2013 Torres ..... A63H 17/262 446/448
8,939,812 B2 * 1/2015 Chan ..... A63H 17/395 446/454
9,352,242 B2 * 5/2016 Rehkemper ..... A63H 30/04
9,427,672 B2 * 8/2016 Picolet ..... A63H 18/00
9,717,998 B2 * 8/2017 Cai ..... A63H 17/26
2001/0044255 A1 * 11/2001 Lee ..... A63H 17/004 446/469
2004/0092206 A1 * 5/2004 Lynders ..... A63H 17/262 446/427
2016/0224043 A1 8/2016 Liu et al.

* cited by examiner

DOUBLE-SIDED TOY CAR CAPABLE OF VERTICAL TURNING WITHIN SEALED TRACK

CROSS-REFERENCE TO RELATED APPLICATIONS

The present application is a national phase entry under 35 USC § 371 of International Application No. PCT/CN2015/082913, filed Jun. 30, 2015, which claims the benefit of and priority to Chinese Patent Application No. 201410517935.7, filed Sep. 30, 2014, the entire disclosures of which are incorporated herein by reference.

FIELD

The present disclosure relates to a double-sided toy car, and more particularly to a double-sided toy car capable of vertical turning within a sealed track.

BACKGROUND

There are various kinds of existing toy cars, and most of them are conventional toy cars running on a single side, i.e. wheels are disposed at the bottom of a car body to make a toy car run. The toy cars have simple designs of transmission structures and single functions, and lack of interestingness. Currently, there is a kind of toy car that is a double-sided toy car, this kind of toy car is provided with wheels both at the top and bottom of its car body, so that the double-sided toy car can run on an obverse side and a reverse side, thus a sealed track for running the double-sided toy car is designed, which is a track body including an upper track for upper wheels of the double-sided car to touch and a lower track for lower wheels of the double-sided car to touch, the double-sided car can run within the sealed track freely. However since a transmission structure of the existing double-sided toy car is cumbersome and both the upper and lower wheels of the double-sided toy car are keeping in touch with the upper and lower tracks of the sealed track, when the double-sided is turning vertically, front wheels enter a vertical turning segment firstly so that an entire forepart of the car body is raised, at the time a relative displacement between the upper and lower wheels of rear wheels will appear, however since that a height of the track is constant, the double-sided toy car is stuck and unable to move frequently. There are three existing methods for handling this. The first one is to omit the design of the vertical turning segment of the sealed track, which means that the distinct performance of the double-sided car running within the sealed track cannot be shown. The second one is to reduce the height of the double-sided car or increase the up-down height of the sealed track, that is, the upper wheels of the double-sided car cannot touch the upper track, thus leaving an enough turning space for the double-sided car at the vertical turning segment so as to achieve the vertical turning, however since there is a gap between the double-sided car and the track, and the double-sided car cannot run on the vertical track and cannot run smoothly within the track because of the gap. The third one is to make the upper and lower wheels of the double-sided car be capable of retracting relative to each other, which can be achieved by hanging a spring on an axle and a car body, thus ensuring that the upper and lower wheels can be retracted when being squeezed at the vertical turning segment, so that the double-sided car cannot to be stuck. However such designs further increase the weight of the double-sided car and the production cost, and the transmission structure is more complicated, a driving force of the double-sided car during the retracting process can be influenced, moreover the spring may be unable to be retracted during use, which means that the double-sided car is stuck at the vertical turning segment as well.

SUMMARY

Regarding problems existing in the prior art, an objective of the present disclosure is to provide a delicately designed double-sided toy car capable of running steadily and smoothly on a vertical turning track having a large arc and a perpendicular track.

In order to reach the above-mentioned objective, a technical solution adopted by the present disclosure is: a double-sided toy car capable of vertical turning within a sealed track, including a car body, a front wheel arranged at a front portion of the car body, protruding above and below the car body and acting as a driven wheel, and a rear wheel arranged at a rear portion of the car body and including a pair of upper driving wheels protruding above the car body and a pair of lower driving wheels protruding below the car body. In which the rear wheel is designed as a wheel having an ability of elastically deformable contraction, a maximum distance between an upper end and a lower end of the front wheels is less than or equal to a maximum distance between the upper and lower driving wheels after the rear wheel is maximally elastically contracted, the maximum distance between the upper and lower driving wheels after the rear wheel is maximally elastically contracted is less than or equal to a height of a sealed track fitted with the toy car, however a maximum distance between the upper and lower driving wheels before the rear wheel is elastically contracted is greater than the height of the sealed track.

In which, in order to achieve that the wheel itself of the rear wheel is able to be elastically deformed, a wheel surface of each of the upper driving wheels and/or the lower driving wheels is provided with an elastic saw tooth, so as to achieve elastic contraction of the rear wheel. Compared with the prior art, the solution is simpler and practical without influence on the driving force of the double-sided car, moreover the elastic saw tooth is in contact with the track surfaces through point contact when the double-sided car is running, thus damages caused by friction between the wheels and the track surfaces may be reduced effectively as well.

The elastic saw tooth may be formed by convex columns or particles having various shapes. The elastic saw tooth according to the present disclosure is configured to be a plurality of circular elastic convex columns spaced from each other and encircling a soft ring, so as to form a jagged wheel ring. The wheel ring is fitted over the wheel surface of each of the upper driving wheels and/or the lower driving wheels, thus facilitating replacement and disassembly thereof.

The front wheel according to the present disclosure may have multiple design proposals. A first proposal is that: the above-mentioned front wheel is configured to be one driven wheel having a diameter larger than a height of the car body and protruding above and below the car body, the driven wheel is rotatably connected to a middle position of the front portion of the car body through a rotating shaft, and the diameter of the driven wheel is less than or equal to the maximum distance between the upper and lower driving wheels after the rear wheel is maximally elastically contracted. A second proposal is that: the above-mentioned front wheel is configured to be a pair of driven wheels each having a diameter larger than a height of the car body and protruding above and below the car body, the pair of driven wheels are rotatably connected to two side positions of the front portion of the car body through a rotating shaft, and the diameter of each the driven wheel is less than or equal to the maximum distance between the upper and lower driving wheels after the rear wheel is maximally elastically contracted. A third proposal is that: the above-mentioned front wheel includes an upper driven wheel protruding above the car body and a pair of lower driven wheels protruding below the car body, the upper driven wheel is connected to a middle position of the front portion of the car body adjacent to an upper end through a rotating shaft, the pair of lower driven wheels are connected to two side positions of the front portion of the car body adjacent to a lower end through a rotating shaft, and a maximum perpendicular distance between the upper and lower driven wheels is less than or equal to the maximum distance between the upper and lower driving wheels after the rear wheel (3) is maximally elastically contracted. A fourth proposal is that: the above-mentioned front wheel includes a pair of upper driven wheels protruding above the car body and one lower driven wheel protruding below the car body, the pair of upper driven wheels are connected to two side positions of the front portion of the car body adjacent to an upper end through a rotating shaft, a pair of lower driven wheels is connected to a middle position of the front portion of the car body adjacent to a lower end through a rotating shaft, and a maximum perpendicular distance between the upper and lower driven wheels is less than or equal to the maximum distance between the upper and lower driving wheels after the rear wheel is maximally elastically contracted. A fifth proposal is that: the above-mentioned front wheel includes a pair of upper driven wheels protruding above the car body and a pair of lower driven wheels protruding below the car body, the upper driven wheels are connected to two side positions of the front portion of the car body adjacent to an upper end through a rotating shaft, the lower driven wheels are connected to two side positions of the front portion of the car body adjacent to an lower end through a rotating shaft, and a maximum perpendicular distance between the upper and lower driven wheels is less than or equal to the maximum distance between the upper and lower driving wheels after the rear wheel is maximally elastically contracted.

Further, in order to achieve a better running performance, a rotating shaft core of the upper driving wheels and a rotating shaft core of the lower driving wheels are located in a same perpendicular cross section perpendicular to the car body.

In order to reduce the weight of the double-sided car as much as possible and improve the running effect thereof, the upper driving wheels and the lower driving wheels are driven by one transmission structure, thus achieving that the upper driving wheels and the lower driving wheels rotate in different directions and at a same speed.

In the present disclosure, since the rear wheel is designed as a wheel having an ability of elastically deformable contraction, and the maximum distance between the upper end and the lower end of the front wheel is configured to be less than or equal to the maximum distance between the upper and lower driving wheels after the rear wheel is maximally elastically contracted, so the car body has a certain angle of being inclined forwards when arranged on a horizontal plane, and the upper driving wheels incline forwards relative to the lower driving wheels of the rear wheel. The maximum distance between the upper and lower driving wheels before the rear wheel is elastically contracted is greater than the height of the sealed track, thus enabling the upper and lower driving wheels of the double-sided car to be in contact with upper and lower track surfaces respectively within the track, ensuring a stable running process, achieving a crawling on a vertical track as well, and the maximum distance between the upper and lower driving wheels after the rear wheel is maximally elastically contracted is less than the height of the sealed track fitted with the toy car, thus ensuring that the double-sided car can pass through a vertical turning segment smoothly. Moreover since the plurality of circular elastic convex columns are spaced from each other and encircle a soft ring to form a jagged wheel ring, the wheel ring is fitted over the rear wheel, the rear wheel are enabled to have an ability of elastic contraction, thus the structure is simple, the installation is convenient, and the replacement is convenient. In addition, the elastic convex column is in contact with the track surface through point contact when the double-sided car is running, so that the driving force of the double-sided car will not be influenced, and on the premise that the adhesive force to the track is increased, the friction loss can be reduced. Moreover since the front wheel is configured as a driven wheel which is used to guide, thus the front wheel may be designed into various types according to requirements, meanwhile the sealed track has different shapes according to different wheels, the applicability is strong, and structures and configurations are diversified, consumers can choose according to their favors. The double-sided toy car of the present disclosure has a simple structure, a delicate design and good applicability, can adapt to sealed tracks of various shapes, and can run within the sealed track smoothly and steadily, thereby adding more playing methods and fun.

The present disclosure will be further described with reference to drawings and embodiments.

DETAILED DESCRIPTION

Figure 1:
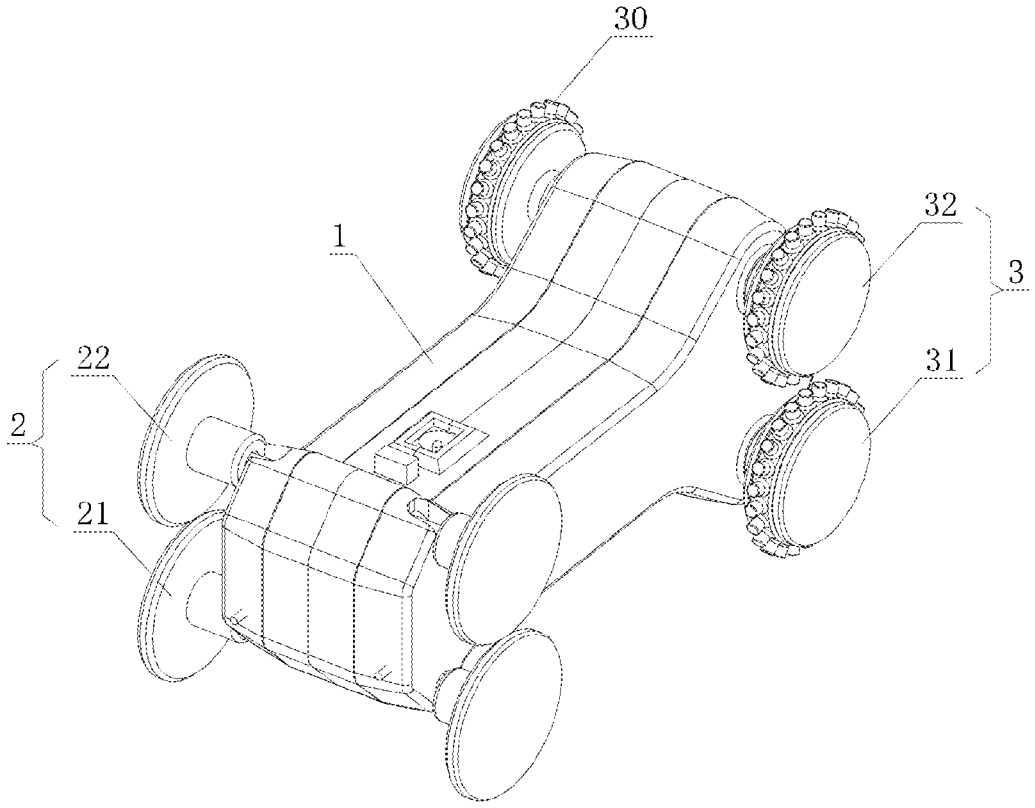
FIG. 1 is a perspective schematic view of a double-sided toy car according to the present disclosure.
Figure 2:
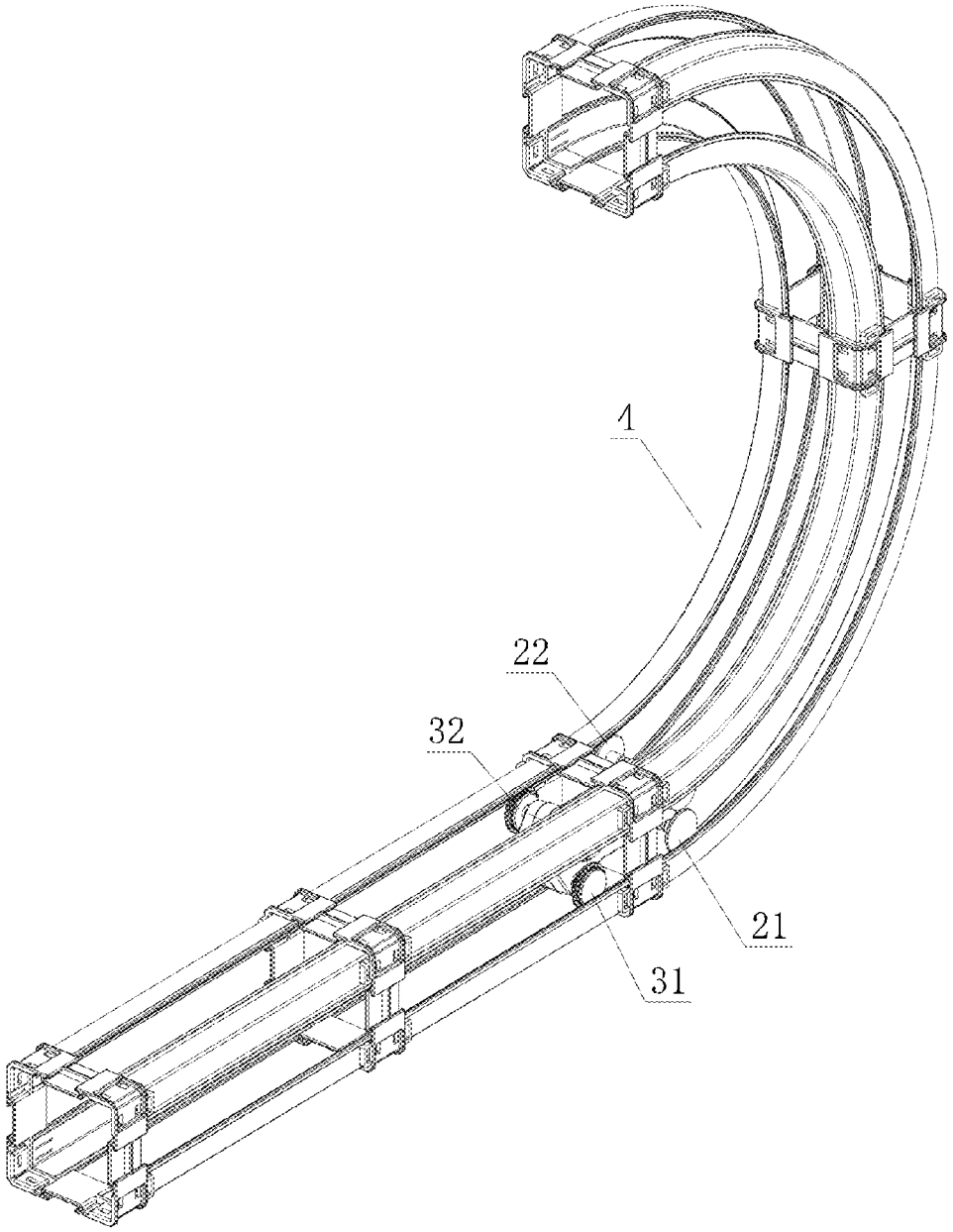
FIG. 2 is a perspective schematic view of a double-sided toy car in a sealed track according to the present disclosure.

As shown in FIGS. 1-4, a double-sided toy car capable of vertical turning within a sealed track according to the present disclosure includes a car body 1, a front wheel 2 arranged at a front portion of the car body 1, protruding above and below the car body 1 and acting as a driven wheel, and a rear wheel 3 arranged at a rear portion of the car body 1 and including a pair of upper driving wheels 32 protruding above the car body 1 and a pair of lower driving wheels 31 protruding below the car body 1. In which the rear wheel 3 is designed as a wheel having an ability of elastically deformable contraction, a maximum distance between an upper end and a lower end of the front wheel 2 is less than or equal to a maximum distance between the upper and lower driving wheels after the rear wheel 3 is maximally elastically contracted, the maximum distance between the upper and lower driving wheels after the rear wheel 3 is maximally elastically contracted is less than or equal to a height of a sealed track 4 fitted with the toy car, however a maximum distance between the upper and lower driving wheels before the rear wheel 3 is elastically contracted is greater than the height of the sealed track 4, thereby enabling the upper and lower driving wheels of the double-sided car within the track 4 to be in contact with upper and lower track surfaces respectively, ensuring a stable running process, achieving a crawling on a vertical track, and ensuring that the double-sided car can pass through a vertical turning segment smoothly.

As shown in FIG. 1, a wheel surface of each of the upper driving wheels 32 and the lower driving wheels 31 according to the embodiment is provided with an elastic saw tooth 30, so as to achieve the elastic contraction of the rear wheel. The elastic saw tooth 30 is configured to be a plurality of circular elastic convex columns spaced from each other and encircling a soft ring, so as to form a jagged wheel ring. The wheel ring is fitted over the wheel surface of each of the upper driving wheels 32 and the lower driving wheels 31 during use, replacement and disassembly thereof are convenient, and compared with the prior art, the solution is simpler and practical without influence on the driving force of the double-sided car, moreover the elastic saw tooth 30 is in contact with the track surfaces through point contact when the double-sided car is running, so that damages caused by friction between the wheels and the track surfaces can be reduced effectively as well. In the embodiment, the solution adopted by the front wheel 2 is that the front wheel 2 includes a pair of upper driven wheels 22 protruding above the car body 1 and a pair of lower driven wheels 21 protruding below the car body 1. The upper driven wheels 22 are rotatably connected to two side positions of the front portion of the car body 1 adjacent to an upper end through a rotating shaft, and the lower driven wheels 21 are rotatably connected to two side positions of the front portion of the car body 1 adjacent to an lower end through a rotating shaft. In the embodiment, a rotating shaft core of the upper driving wheels 32 and an rotating shaft core of the lower driving wheels 31 are located in a same perpendicular cross section perpendicular to the car body 1, moreover the upper driving wheels 32 and the lower driving wheels 31 are driven by one transmission structure, so that the upper driving wheels 32 and the lower driving wheels 31 rotate in different directions and at a same speed.

Figure 3:
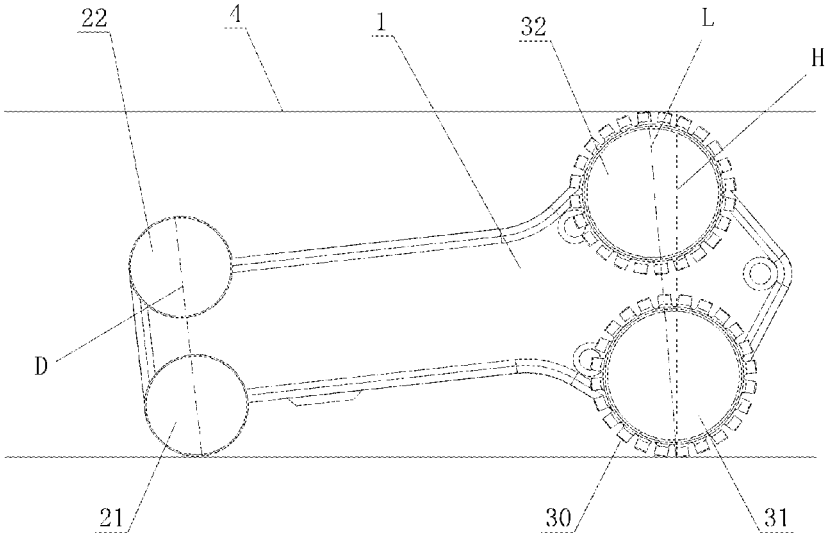
FIG. 3 is a side schematic view of the double-sided toy car at a horizontal segment of the sealed track (sketch) shown in FIG. 2.
Figure 4:
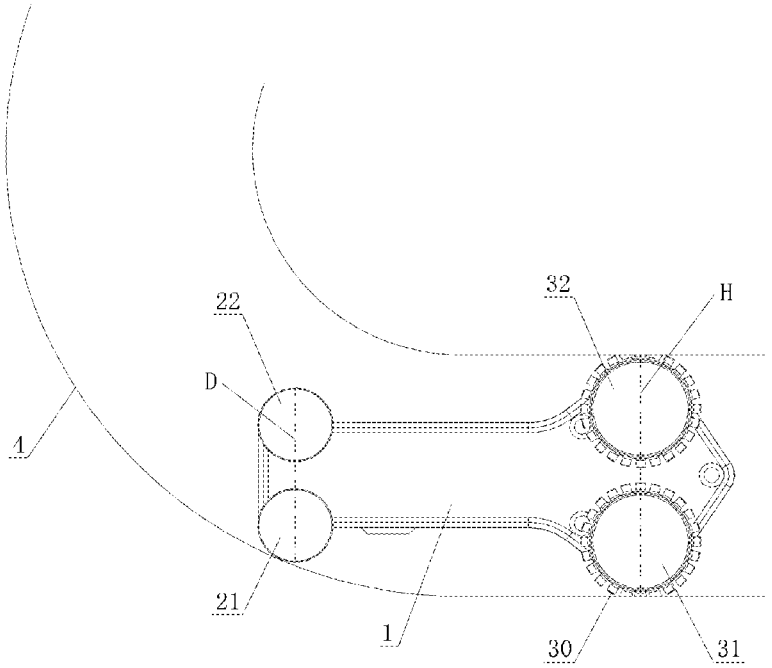
FIG. 4 is a side schematic view of the double-sided toy car at a turning segment of the sealed track (sketch) shown in FIG. 2.

As shown in FIGS. 3 and 4, reference numeral D in the drawings represents a maximum perpendicular distance between the upper and lower driving wheels of the front wheel 2, we suppose that the elastic saw tooth of rear wheel 3 in the condition shown in FIG. 3 exactly has no elastic deformation, at the moment, the maximum distance between the upper and lower driving wheels of the rear wheel 3 without elastic contraction is equal to a connection distance between points where the upper and lower driving wheels are in contact with the upper and lower track surfaces respectively, which is denoted by L, the height of the upper and lower tracks is denoted by H, and a maximum amount of the elastic contraction of the elastic saw tooth 30 is denoted by R. It can be known from FIG. 3 that, D is significantly less than L minus R, so when the car body 1 is placed on the horizontal plane, the car body 1 presents a state of inclining forwards, so regarding the rear wheel 3, the upper driving wheels 32 are placed at a front position relative to the lower driving wheels 31, and at the moment L is greater than H. As shown in FIG. 4, the car body 1 in the condition shown in FIG. 4 shows that the front wheel 2 has been entered the vertical turning segment while the rear wheel 3 is still at a horizontal track segment, at the moment since the front wheel 2 is uplifted, the upper driving wheels 32 moves backwards relative to the lower driving wheels 31, hence the elastic saw tooth 30 begins to be elastically contracted. When the upper driving wheels 32 moves to a position right above the lower driving wheels 31 as shown in FIG. 4, at the moment the connection distance between points where the upper and lower driving wheels are in contact with the upper and lower track surfaces respectively is equal to H, and the elastic contraction at the moment is most serious, in order to avoid that the double-sided car is stuck at the position, the amount of elastic contraction must be less than or equal to R, that is, L minus R must be less than or equal to H, so as to ensure that the double-sided car cannot be stuck.

Although the present disclosure is described with reference to specific embodiments, however these descriptions are not meant to limit the present disclosure. Referring to the descriptions of the present disclosure, some other variants of the disclosed embodiments can be expected by those skilled in the art, and the variants should be within the scope defined by the corresponding claims.

What is claimed is:

1. A double-sided toy car capable of vertical turning within a sealed track comprising:

a car body (1);

a front wheel (2) arranged at a front portion of the car body (1), protruding above and below the car body (1) and acting as a driven wheel; and a rear wheel (3) arranged at a rear portion of the car body (1) and comprising a pair of upper driving wheels (32) protruding above the car body (1) and a pair of lower driving wheels (31) protruding below the car body (1), wherein the rear wheel (3) is designed as a wheel having an ability of elastically deformable contraction, a maximum distance between an upper end and a lower end of the front wheel (2) is less than or equal to a maximum distance between the upper and lower driving wheels after the rear wheel (3) is maximally elastically contracted, the maximum distance between the upper and lower driving wheels after the rear wheel (3) is maximally elastically contracted is less than or equal to a height of a sealed track (4) fitted with the toy car, however a maximum distance between the upper and lower driving wheels before the rear wheel (3) is elastically contracted is greater than the height of the sealed track (4).

2. The double-sided toy car according to claim 1, wherein a wheel surface of each of the upper driving wheels (32) and/or the lower driving wheels (31) of the rear wheel (3) is provided with an elastic saw tooth (30), so as to achieve elastic contraction of the rear wheel.

3. The double-sided toy car according to claim 2, wherein the elastic saw tooth (30) is configured to be a plurality of circular elastic convex columns spaced from each other and encircling a soft ring, so as to form a jagged wheel ring, and the wheel ring is fitted over the wheel surface of each of the upper driving wheels (32) and/or the lower driving wheels (31).

4. The double-sided toy car according to claim 1, wherein the front wheel (2) is configured to be one driven wheel having a diameter larger than a height of the car body (1) and protruding above and below the car body (1), the driven wheel is rotatably connected to a middle position of the front portion of the car body (1) through a rotating shaft, and the diameter of the driven wheel is less than or equal to the maximum distance between the upper and lower driving wheels after the rear wheel (3) is maximally elastically contracted.

5. The double-sided toy car according to claim 1, wherein the front wheel (2) is configured to be a pair of driven wheels each having a diameter larger than a height of the car body (1) and protruding above and below the car body (1), the pair of driven wheels are rotatably connected to two side positions of the front portion of the car body (1) through a rotating shaft, and the diameter of each the driven wheel is less than or equal to the maximum distance between the upper and lower driving wheels (3) after the rear wheel is maximally elastically contracted.

6. The double-sided toy car according to claim 1, wherein the front wheel (2) comprises one upper driven wheel protruding above the car body (1) and a pair of lower driven wheels protruding below the car body (1), the upper driven wheel is connected to a middle position of the front portion of the car body (1) adjacent to an upper end through a rotating shaft, the pair of lower driven wheels is connected to two side positions of the front portion of the car body (1) adjacent to a lower end through a rotating shaft, and a maximum perpendicular distance between the upper and lower driven wheels is less than or equal to the maximum distance between the upper and lower driving wheels after the rear wheel (3) is maximally elastically contracted.

7. The double-sided toy car according to claim 1, wherein the front wheel (2) comprises a pair of upper driven wheels protruding above the car body (1) and one lower driven wheel protruding below the car body (1), the pair of upper driven wheels is connected to two side positions of the front portion of the car body (1) adjacent to an upper end through a rotating shaft, a pair of lower driven wheels is connected to a middle position of the front portion of the car body (1) adjacent to a lower end through a rotating shaft, and a maximum perpendicular distance between the upper and lower driven wheels is less than or equal to the maximum distance between the upper and lower driving wheels after the rear wheel (3) is maximally elastically contracted.

8. The double-sided toy car according to claim 1, wherein the front wheel (2) comprises a pair of upper driven wheels (22) protruding above the car body (1) and a pair of lower driven wheels (21) protruding below the car body, the upper driven wheels (22) are connected to two side positions of the front portion of the car body (1) adjacent to an upper end through a rotating shaft, the lower driven wheels (21) are connected to two side positions of the front portion of the car body (1) adjacent to an lower end through a rotating shaft, and a maximum perpendicular distance between the upper and lower driven wheels is less than or equal to the maximum distance between the upper and lower driving wheels after the rear wheel (3) is maximally elastically contracted.

9. The double-sided toy car according to claim 1, wherein a rotating shaft core of the upper driving wheels (32) and a rotating shaft core of the lower driving wheels (31) are located in a same perpendicular cross section perpendicular to the car body (1).

10. The double-sided toy car according to claim 1, wherein the upper driving wheels (32) and the lower driving wheels (31) are driven by one transmission structure, thus achieving that the upper driving wheels (32) and the lower driving wheels (31) rotate in different directions and at a same speed.

11. The double-sided toy car according to claim 2, wherein a rotating shaft core of the upper driving wheels (32) and a rotating shaft core of the lower driving wheels (31) are located in a same perpendicular cross section perpendicular to the car body (1).

12. The double-sided toy car according to claim 2, wherein the upper driving wheels (32) and the lower driving wheels (31) are driven by one transmission structure, thus achieving that the upper driving wheels (32) and the lower driving wheels (31) rotate in different directions and at a same speed.

13. The double-sided toy car according to claim 1, wherein the pair of upper driving wheels (32) and the pair of lower driving wheels (31) are in contact with the sealed track (4) and rotate in opposite directions when the double-sided toy car vertically turns within the sealed track (4).

* * * * *